United States Patent [19]

Otto et al.

[11] 4,120,381

[45] Oct. 17, 1978

[54] ELEVATOR SYSTEM

[75] Inventors: Paul R. Otto, Marlboro; William N. C. Leang, Randolph Township, Morris County, both of N.J.

[73] Assignee: Westinghouse Electric Corp., Pittsburgh, Pa.

[21] Appl. No.: 771,610

[22] Filed: Feb. 24, 1977

[51] Int. Cl.[2] ..... B66B 1/46

[52] U.S. Cl. ..... 187/29 R; 340/19 R

[58] Field of Search ..... 187/29; 340/19, 21

[56] References Cited

U.S. PATENT DOCUMENTS 3,952,837 4/1976 Rice ..... 187/29

*Primary Examiner*—Robert K. Schaefer
*Assistant Examiner*—W. E. Duncanson, Jr.
*Attorney, Agent, or Firm*—D. R. Lackey

[57] ABSTRACT

An elevator system including an elevator car mounted in a building to serve the floors therein. A car call station in the elevator car includes a plurality of car call pushbuttons and associated lamps. Each pushbutton requires only a single set of contacts and a single conductor to register a car call, drive the associated lamp, and to provide a "button actuated" signal each time the pushbutton is actuated.

7 Claims, 2 Drawing Figures

ELEVATOR SYSTEM

BACKGROUND OF THE INVENTION

1. Field of the Invention

The invention relates in general to elevator systems, and more specifically to new and improved car call stations and circuitry for elevator cars.

2. Description of the Prior Art

There are various circuit arrangements used in the prior art for registering car calls on the car call push button station located in the elevator car. For example, the push buttons for registering car calls in the car stations may be wired using DC, and the button is grounded to register a call. If a call wire in the hatch trail cable is shorted to ground for some reason, a call would be falsely registered. If this occurs during a fire emergency, a call could be falsely registered for the floor of the fire.

In another arrangement, a combination of AC and DC is used. Positive DC registers the car call and AC shows "re-registering" of the call. In these systems an AC relay, a special transformer, and additional wiring in the control cabinet is required. Further, a relay per pushbutton is also required.

U.S. Pat. No. 3,519,106 which is assigned the same assignee as the present application, discloses a new and improved pushbutton circuit arrangement for registering calls for elevator service and for driving the associated lamp, which circuit arrangement reduces the amount of wiring required by using opposite polarity pulses and a common transmission channel for the pulses. When the pushbuttons are in the car call station located in the elevator car, the pushbuttons are each provided with a second set of contacts. The second set of contacts of each pushbutton is connected to provide a "button actuated" signal for the door circuits. The door circuits utilize the signal to shorten or cut out the remaining door non-interference time. The "button actuated" signal must be provided each time a pushbutton is actuated, i.e., when the button is actuated to register a call, and also when it is actuated after the call is placed and the associated lamp energized.

When an elevator car stops for a hall call, the door remains open for a predetermined period of time, referred to as the door non-interference time. When the prospective passenger, or passengers, enter the car and place a car call on the car call pushbutton station, the placing of the call is a good indication that all passenger transfers have been made. Trip time may thus be reduced by shortening, or cancelling any remaining non-interference time and initiate door closure immediately. If an incoming passenger desires to travel to a floor for which a car call has already been registered by a passenger during a prior stop, actuating this pushbutton again should also function to shorten or cancel the remaining door non-interference time. The extra set of contacts in each pushbutton of the car call station of the hereinbefore mentioned U.S. Patent performs this function.

Pushbuttons with two sets of contacts, however, have not proven to be as reliable as desired. For example, if the pushbutton is not pressed directly in its center, it is possible for one or the other of the two sets of contacts to make, resulting in a car call being registered without a reduction in door open time, or a reduction in door open time without a call being entered. Thus, it would be desirable to be able to register a call and provide a "button actuated" signal each time the pushbutton is actuated, while using only a single set of contacts. Further, it would be desirable to do this, and to drive the associated lamp, while utilizing a single or common transmission channel or conductor between each pushbutton/lamp combination and the associated car call control station.

SUMMARY OF THE INVENTION

Briefly, the present invention is a new and improved elevator system which includes an elevator car mounted for movement in a building to serve the floors therein. A car call station located in the elevator car includes a plurality of pushbutton/lamp combinations for registering car calls by the passengers. Each pushbutton includes a single set of contacts connected between a first source of unidirectional potential having a first polarity, and a transmission channel, and its associated lamp is connected between a second source of unidirectional potential having a second polarity, which is opposite to the first polarity, and the same transmission channel. The actuation of a pushbutton applies a signal of the first polarity to the transmission channel. This signal sets a car call memory associated with this pushbutton to register the car call, and it is also used by a button actuated sensor to provide a "button actuated" signal for the door control. The set call memory actuates a lamp driver to energize the associated lamp from the second source of unidirectional potential. The common transmission channel thus carries current of the second polarity while the lamp is energized. Actuation of the pushbutton while the call is registered, and thus while the associated lamp is energized, places signals of the first polarity on the common transmission channel which is recognized by the "button actuated" sensor as a contact closure, and it provides the button actuated signal for the door control.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENT

Figure 1:
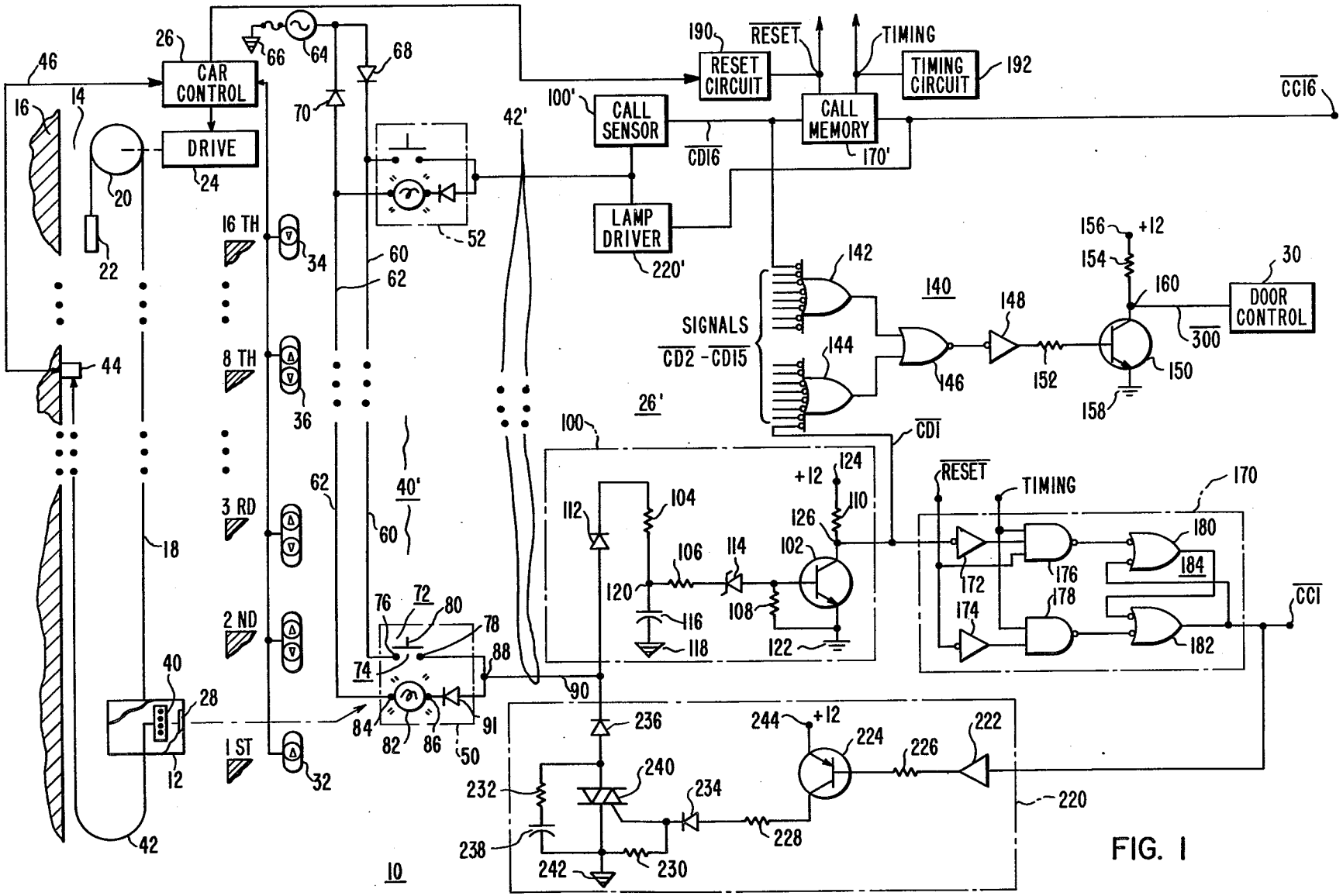
FIG. 1 is a partially schematic and partially block diagram of an elevator system constructed according to the teachings of the invention.

Referring now to the drawings, and to FIG. 1 in particular, there is shown an elevator system 10 constructed according to the teachings of the invention. Elevator system 10 includes an elevator car 12 mounted in the hatch or hoistway 14 of a building 16 having a plurality of floors to be served by the elevator car. The building 16 may have any number of floors, and for purposes of example it will be assumed that the building has 16 floors, only a few of which are illustrated in FIG. 1. For purposes of example, the elevator system 10 is illustrated as being of the traction type, and thus is supported by a plurality of ropes, shown generally at 18, which ropes are reeved over a traction sheave 20 and connected to a counterweight 22. The invention, however, is equally applicable to hydraulic elevators. the traction sheave 20 is driven by any suitable drive means 24, such as an electric motor, with the drive means 24 being controlled by car control 26 mounted in the machine room of the building 16. The elevator car 12 includes a door 28 mounted to open and close an entranceway in the elevator car, in unison with a hatch door (not shown), with the door 28 being responsive to door control 30.

Hall call pushbuttons, such as up pushbutton 32 located in the hallway of the first floor, down pushbutton 34 located in the hallway of the sixteenth floor, and up and down pushbuttons 36 located in the hallways of the intermediate floors, are used by a prospective passenger to register a hall call and request that the elevator car serve the associated floor in the selected service direction. When the elevator car 12 arrives at the floor of a hall call it open its doors 28 and the associated hatch door for a predetermined non-interference time, selected to provide ample time for passenger transfers to take place. An entering passenger selects the destination floor by actuating an appropriate car call pushbutton on a car station 40, which includes a pushbutton/lamp combination for each floor the elevator car 12 is capable of serving. Registration of the car call is directed to the car control 26 via a traveling cable 42 which interconnects the elevator car 12 and a junction box 44 mounted in the hoistway 14, and via a cable 46 from the junction box 44 to the car control 26. Registration of the car call sets the call memory for the selected floor, it drives the lamp associated with the actuated pushbutton, and it provides a button actuated signal which is used by the door control circuits to shorten or cancel any of the remaining door non-interference time. The present invention relates to an improvement in the registration of calls for elevator service, the driving of the lamps, and the generation of the button actuated signal. In order to simplify the drawing the functions of an elevator system which may be conventional are illustrated in block form. The hereinbefore mentioned U.S. Pat. No. 3,519,106 is hereby incorporated into the present application by reference as illustrative of an elevator system which may be modified according to the teachings of the invention.

The car station 40 is shown schematically in FIG. 1 with reference 40', the traveling cable 42 is shown schematically with reference 42', and portions of the car control 26 are illustrated schematically with reference 26'.

Car station 40' includes a plurality of push-button/-lamp combinations, one for each floor served by the elevator car 12, such as 16 for a 16-floor building, with a pushbutton/lamp combination 50 being illustrated for placing a car call for the first floor, and a pushbutton/-lamp combination 52 being illustrated for placing a car call for the sixteenth floor. The remaining pushbutton/-lamp combinations would be similar. The circuitry responsive to each pushbutton/lamp combination is similar, and thus it is illustrated in detail relative to only the pushbutton/lamp combination 50. The various functions relative to the pushbutton/lamp combination 52 are illustrated in block form. The block functions related to pushbutton/lamp combination 52 will be identified with the same reference numerals as the comparable functions shown relative to pushbutton/lamp combination 50, except for the addition of a prime mark.

The car station 40' includes first and second sources 60 and 62, respectively, of unidirectional potential, represented by conductors, with the first source 60 providing a unidirectional potential of a first polarity, and with the second source 62 providing a unidirectional potential of a second polarity, which of course is opposite to the first polarity. When the visual indicating means or lamp associated with each pushbutton is an incandescent lamp, or a neon lamp, for example, the first and second sources 60 and 62 of unidirectional potential may be positive and negative half cycles, respectively, of a source 64 of alternating potential, such as a 60 hz. source, which has one terminal connected to power ground 66 and its other terminal connected to sources 60 and 62 via oppositely poled rectifiers 68 and 70, respectively. If the visual indicating means is a solid-state device such as a light-emitting diode, the 60 hz. frequency is not high enough to prevent flicker, and thus in this situation, the first and second sources may include an oscillator which provides positive and negative half cycles at a suitable rate, such as 1 khz. For purposes of example, it will be assumed that the visual indicating means is an incandescent lamp.

Each pushbutton/lamp assembly, such as assembly 50, includes a pushbutton 72 having a single set 74 of stationary contacts 76 and 78 and an actuating or shorting member 80 which electrically interconnects first and second contacts 76 and 78, respectively, while the actuating member 80 is manually depressed. Each pushbutton/lamp assembly, such as assembly 50, also includes an electro-responsive visual indicating means, which as hereinbefore stated, will be assumed to be an incandescent lamp 82 having first and second terminals 84 and 86, respectively.

The first contact of each of the pushbuttons 72 is connected to the first source or conductor 60, and the first terminal 84 of each of the lamps 82 is connected to the second source or conductor 62. The second contact 78 of each pushbutton 72 is connected to the second terminal 86 of its associated lamp, and the common connection 88 is connected to a single transmission channel or conductor 90. With an incandescent lamp a diode 91 is required in series with the lamp 82 to prevent sneak-feed through the lamps when a pushbutton is actuated. If a light emitting diode is used instead of an incandescent lamp, diode 91 would not be required. In the elevator system 10 of FIG. 1, it will be assumed that the car call memories are located in the machine room, such as in the penthouse, and each conductor 90 from each pushbutton/lamp combination will be directed to the car control 26' via the traveling cable 42'. The present invention also provides advantages for systems in which the car call memories are located in the elevator car, with the car calls being serialized for transmission to the car control 26' via a single wire. These advantages are due to the fact that only a single set of contacts is required in each pushbutton, instead of a double set, and the fact that only a single wire is required for each pushbutton/lamp assembly, which reduces the amount of station wiring required.

Conductor 90 is connected to a "call button actuated" sensor 100 which is responsive to the polarity of signals present on conductor 90. Sensor 100 includes an NPN transistor 102, resistors 104, 106, 108 and 110, rectifier or diode 112, Zener diode 114, and a capacitor 116. Conductor 90 is connected to power ground 118 via diode 112, resistor 104 and capacitor 116, with diode 112 being poled to conduct current from conductor 90 to power ground 118. The base of transistor 102 is connected to the junction 120 between resistor 104 and capacitor 116 via Zener diode 114 and resistor 106. Zener diode 114 is poled to block current flow into the base until the signal at junction 120 reaches a predetermined magnitude, to prevent false triggering. The emitter of transistor 102 is connected to signal ground 122, and resistor 108 is connected between the base and the emitter. The collector of transistor 102 is connected to a source of unidirectional potential via resistor 110, such as a plus 12 volt source represented by terminal 124. An output signal $\overline{CD1}$ is provided at the junction 126 between resistor 110 and the collector.

Figure 2:
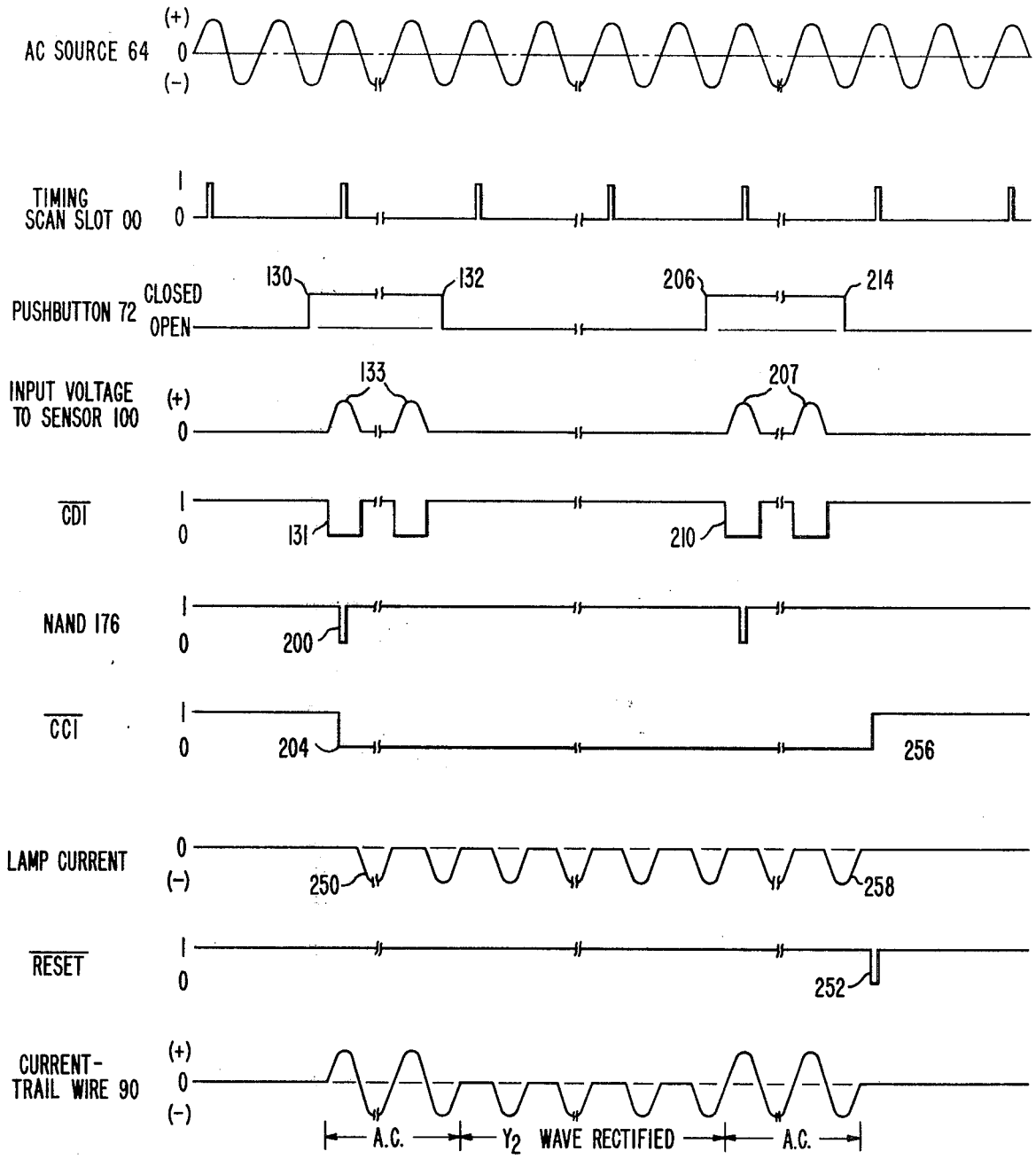
FIG. 2 is a graph of signals at selected points of the elevator system shown in FIG. 1, which aids in understanding the operation thereof.

In describing the operation of the pushbutton sensor 100, FIG. 2 will be referred to. The waveforms illustrated in FIG. 2 are in simple form, without any attempt being made to illustrate phase shifts due to inductive loads, or curve modifications due to RC time constants.

When pushbutton 72 is actuated, indicated at 130 in FIG. 2, positive half cycles 133 of the unidirectional source 60 are applied to sensor 100, breaking down the Zener diode 114 and providing base drive current for transistor 102, turning it on. When transistor 102 becomes conductive, its collector and junction 126 are connected to signal ground 122 and the button actuated signal $\overline{CD1}$ goes low or true, indicated at 131 in FIG. 2. Signal $\overline{CD1}$ is a square wave corresponding to the negative of the positive half cycle input. The square wave $\overline{CD1}$ persists while the pushbutton is depressed, and it returns to logic 1 when the pushbutton is released at 132 in FIG. 2.

Signal $\overline{CD1}$ from the call button sensor 100 is applied to a circuit 140 which provides a signal $\overline{300}$ when any of the 16 pushbuttons of the call station 40' is actuated, which signal is applied to the door control 30 for shortening or cancelling the door non-interference time. Circuit 140 includes a plurality of NAND gates, such as NAND gates 142 and 144, with their inputs being connected to receive the output signals from each sensor 100, such as signal $\overline{CD1}$ from sensor 100 and signal $\overline{CD16}$ from sensor 100'. The outputs of NAND gates 142 and 144 are connected to the inputs of NOR gate 146, and the output of NOR gate 146 is inverted by NOT gate 148 and applied to the base of an NPN transistor 150 via a resistor 152. The collector of transistor 150 is connected to a source of unidirectional potential, such as a plus 12 volt source represented by terminal 156, via a resistor 154, and the emitter is connected to signal ground 158. The junction 160 between the collector and the resistor 154 provides the signal $\overline{300}$ for the door control 30. When any button actuated sensor, such as sensor 100, provides a low signal, such as a low signal $\overline{CD1}$, the output of the associated NAND gate is driven high, the output of NOR gate 146 is driven low, and NOT gate 148 applies a logic 1 signal to the base of transistor 150, turning it on. Junction 160 goes from plus 12 volts to signal ground, which provides a low or true signal $\overline{300}$ for the door control 30, indicating a car call pushbutton has been actuated.

The signal $\overline{CD1}$ from sensor 100 is also applied to a car call memory 170 associated with pushbutton 72. Car call memory 170 includes NOT gates 172 and 174, and NAND gates 176, 178, 180 and 182. NAND gates 180 and 182 are dual input NAND gates which are cross-coupled to provide a flip-flop 184. NAND gate 176 is a three input gate, with the output of sensor 100 being connected to one input via NOT gate 172. Another input is connected to receive a signal $\overline{RESET}$ from a reset circuit 190, and the remaining input is connected to receive timing signals from a system timing circuit 192. The reset circuit 190 provides a true signal $\overline{RESET}$ when the elevator car serves a car call, such as when deceleration is initiated to stop the elevator car at the floor associated with the car call. The reset signal $\overline{RESET}$ is a serial signal which is true during the time slot, also referred to as a scan slot, which is associated with the call to be reset. The timing circuit 192 provides a true (high) signal to call memory 170 during the time slot assigned to pushbutton 72. For 16 floors, the timing circuit 192 would repetitively provide scan slots 00 through 15, with scan slot 00 being assigned to the first floor. Thus, the timing signal applied to call memory 170 will be true only during scan slot 00 out of each scan slot cycle.

When pushbutton 72 is actuated, driving signal $\overline{CD1}$ low, NOT gate 172 applies a logic one to NAND gate 176. If the reset signal $\overline{RESET}$ is high when the timing circuit provides a logic one signal during scan slot 00, the output of NAND gate 176 goes low, indicated at 200 in FIG. 2, to set flip-flop 184 and provide a true (low) car call signal $\overline{CC1}$, indicated at 204 in FIG. 2. The output of NAND gate 176 is connected to an input of NAND gate 180, causing the output of NAND gate 180 to go high when the output of NAND gate 176 goes low. The output of NAND gate 178 is connected to an input of NAND gate 182. NAND gate 178 is a dual input NAND gate, with one input connected to receive timing signals from the timing circuit 192, and the other input connected to receive the signal $\overline{RESET}$ via the NOT gate 174. Thus, in the absence of a true signal $\overline{RESET}$, the output of NAND gate 178 is held high, and when the output of NAND gate 180 goes high, NAND gate 182 has two logic one inputs, driving output terminal $\overline{CC1}$ low to provide a true signal $\overline{CC1}$ and indicate that a car call has been registered by car call pushbutton 72 for the first floor.

If the pushbutton 72 is actuated again, as illustrated at 206 in FIG. 2, the positive half cycles 207 which pass through pushbutton 72 are recognized by sensor 100 as a contact closure, and a true signal $\overline{CD1}$ is provided, indicated at 210. The true signal $\overline{CD1}$ is applied to circuit 140, which in turn provides a true signal 300 for the door control 30, notwithstanding that the call memory flip-flop 184 is still set and is still providing a true signal $\overline{CC1}$. The signal $\overline{CD1}$ is in the form of a square wave, as hereinbefore described, with the square wave being provided until the pushbutton is released, as indicated at 214 in FIG. 2.

When flip-flop 184 of the call car memory 170 is set and is providing a low output signal $\overline{CC1}$, this low output signal also turns on the lamp 82 via a lamp driver circuit 220. The lamp driver circuit 220 includes a buffer amplifier 222, a PNP transistor 224, resistors 226, 228, 230 and 232, diodes 234 and 236, a capacitor 238, and a thyristor 240, such as the Triac illustrated, or a silicon controlled rectifier. Triac 240 has one terminal connected to conductor 90 via diode 236, and its other terminal is connected to power ground 242. Diode 236 is poled to conduct current from power ground towards conductor 90. Resistor 232 and capacitor 238 are serially connected across the main terminals of Triac 240 to limit dv/dt and prevent false triggering. Gate drive current is provided by PNP transistor 224 which has its emitter connected to a source of unidirectional potential, such as a plus 12 volt source represented by terminal 244, its base is connected to be responsive to signal $\overline{CC1}$ via buffer 22 and resistor 226, and its collector is connected to the gates of the Triac 240 via resistor 228 and diode 234. Diode 234 is poled to conduct current from the collector to the gate. Resistor 230 is connected from the gate to power ground.

When the call memory 170 is not set, signal $\overline{CC1}$ is high and transistor 224 is cut off. Triac 240 is nonconductive, and the lamp 182 is deenergized. When pushbutton 72 is actuated at 130 in FIG. 2, and the call memory 170 is set to provide a true signal $\overline{CC1}$ at 204 in FIG. 2, transistor 224 provides gate drive current for the Triac 240. Thus, on the negative half cycles of AC applied to lamp 82 from source 62, a current path is established from power ground 242 through the Triac 240, diode 236 and lamp 82, and the lamp 82 is energized as indicated starting with the negative half cycle 250 in FIG. 2.

As illustrated in FIG. 2 current flows through the pushbutton 72 when actuated, during each positive half cycle of the AC source 64, and current flows through the lamp 82 during each negative half cycle of the AC source 64, when the call memory is set, resulting in the trail wire current indicated in FIG. 2. The trail wire current in conductor 90 is an alternating current during the time the pushbutton is depressed, and a half wave rectified current during the time the lamp is energized without simultaneous pushbutton actuation.

When the elevator car 12 starts to serve the car call set by pushbutton 72, such as when the elevator car 12 initiates slowdown to stop at the first floor, the serial reset signal $\overline{RESET}$ will go low during scan slot 00 associated with the first floor. This is indicated at 252 in FIG. 2. The low reset signal $\overline{RESET}$ is changed to the logic one level by NOT gate 174, and the timing signal will be high during scan slot 00, causing NAND gate 178 to output a logic zero and reset flip-flop 180. The resetting of flip-flop 180 causes signal $\overline{CC1}$ to go high, indicated at 256 in FIG. 2, and current through the lamp 82 will be cut off after negative half cycle 258 because the Triac 240 will lose its gate drive current when signal $\overline{CC1}$ goes high to turn off transistor 224.

In summary, there has been disclosed a new and improved elevator system which overcomes certain problems associated with various car call circuits of the prior art, while simplifying the prior art circuits and requiring less wiring. With the new and improved car call circuits disclosed herein, if a call wire in a trail cable is shorted to ground, it will blow a fuse in the power supply instead of falsely registering a car call. The new and improved car call circuit requires only one wire to each pushbutton/lamp assembly, and only one set of contacts is required in the pushbutton, while still providing a "button actuated" signal for the door circuit each time a pushbutton is actuated. In the new and improved call input circuit disclosed herein, the call pushbuttons may simply be connected to an AC line. This AC line is half-wave rectified to produce both the positive half cycle and the negative half cycle of the AC wave. The pushing of a pushbutton is sensed during a positive half cycle while an indicating lamp is driven during the negative half cycle. The pushing of a call button introduces the positive half cycle of the AC wave at the input of a call sensing circuit. When the pushbutton is released, the positive half cycle will disappear at the input of the call sensing circuit. However, the negative half cycle is still present at the lamp since the triac is still being turned on by the call memory circuit. If the pushbutton is actuated again, the sensing circuit will again produce the $\overline{300}$ signal for the door circuits.

While the invention is particularly useful for the car call function described, it may also be used with the hall call pushbutton stations 32, 34 and 36.

We claim as our invention:

1. An elevator system, comprising:

a building having a plurality of floors, an elevator car mounted in said building, motive means for said elevator car for moving said elevator car to serve the floors in said building, call means for registering a call for elevator service including a plurality of pushbuttons and associated visual indicating means, and a single call wire for each pushbutton and its associated visual indicating means, a source of alternating potential, a first diode connected to said source of alternating potential providing half cycles of a first polarity, a second diode connected to said source of alternating potential providing half cycles of a second polarity, each of said pushbuttons and its associated visual indicating means having first ends connected in common to the associated single call wire, and second ends connected to said first and second diodes, respectively, a plurality of sensor means, each of said sensor means being connected to a different call wire and being responsive to half cycles of the first polarity appearing on the call wire for providing a first signal while the associated pushbutton is actuated, call memory means for each pushbutton switchable between first and second conditions, each of said call memory means switching from its first to its second condition in response to its associated sensor means providing a first signal, with said second condition indicating the registration of a call, driver means for each visual indicating means responsive to an associated call memory means being in its second condition for energizing its associated visual indicating means from half cycles of the second polarity, and reset means switching a selected call memory means back to its first condition when an associated registered call has been answered, each of said sensor means providing a first signal each time its associated pushbutton is actuated to provide half cycles of the first polarity on the associated call wire notwithstanding half cycles of the second polarity on the call wire when said pushbutton is actuated.

2. An elevator system, comprising:

a building having a plurality of floors, an elevator car mounted in said building, motive means for said elevator car for moving said elevator car to serve the floors in said building, call means for registering a call for elevator service including at least one pushbutton and associated visual indicating means, a first source of unidirectional potential having a first polarity, a second source of unidirectional potential having a second polarity, opposite said first polarity, said first and second sources providing pulses alternately, said pushbutton and visual indicating means each having first ends connected in common and second ends connected to said first and second sources, respectively, of unidirectional potential, sensor means responsive to said first source appearing at the common connection for providing a first signal while said pushbutton is actuated, call memory means switchable between first and second conditions, said call memory means switching from its first to its second condition in response to said sensor means providing said first signal, with said second condition indicating the registration of a call, driver means responsive to said call memory means being in its second condition for energizing said visual indicating means from said second source, and reset means switching said call memory means back to its first condition when the registered call has been answered, said sensor means providing said first signal each time said pushbutton is actuated notwithstanding said call memory means being in its second condition when said pushbutton is actuated.

3. An elevator system, comprising:

a building having a plurality of floors, an elevator car mounted in said building, motive means for said elevator car for moving said elevator car to serve the floors in said building, call means for registering a call for elevator service including at least one pushbutton and associated visual indicating means, a first source of unidirectional potential having a first polarity, a second source of unidirectional potential having a second polarity, opposite said first polarity, said first and second sources including a source of alternating potential with the first source including rectifier means connected to said source of alternating potential for providing half cycles of one polarity, and the second source including rectifier means connected to said source of alternating potential for providing half cycles of the opposite polarity, said pushbutton and visual indicating means each having first ends connected in common and second ends connected to said first and second sources, respectively, of undirectional potential, sensor means responsive to said first source appearing at the common connection for providing a first signal while said pushbutton is actuated, call memory means switchable between first and second conditions, said call memory means switching from its first to its second condition in response to said sensor means providing said first signal, with said second condition indicating the registration of a call, driver means responsive to said call memory means being in its second condition for energizing said visual indicating means from said second source, and reset means switching said call memory means back to its first condition when the registered call has been answered, said sensor means providing said first signal each time said pushbutton is actuated notwithstanding said call memory means being in its second condition when said pushbutton is actuated.

4. An elevator system, comprising:

a building having a plurality of floors, an elevator car mounted in said building, motive means for said elevator car for moving said elevator car to serve the floors in said building, call means for registering a call for elevator service including at least one pushbutton and associated visual indicating means, said call means being located within the elevator car, a door on said elevator car, door control means for controlling the operation of said door, a first source of unidirectional potential having a first polarity, a second source of unidirectional potential having a second polarity, opposite said first polarity, said pushbutton and visual indicating means each having first ends connected in common and second ends connected to said first and second sources, respectively, of unidirectional potential, sensor means responsive to said first source appearing at the common connection for providing a first signal while said pushbutton is actuated, call memory means switchable between first and second conditions, said call memory means switching from its first to its second condition in response to said sensor means providing said first signal, with said second condition indicating the registration of a call, driver means responsive to said call memory means being in its second condition for energizing said visual indicating means from said second source, and reset means switching said call memory means back to its first condition when the registered call has been answered, said sensor means providing said first signal each time said pushbutton is actuated notwithstanding said call memory means being in its second condition when said pushbutton is actuated, said sensor means being connected to said door control means such that the generation of the first signal modifies the operation of said door control means.

5. The elevator system of claim 1 including means responsive to the sensor means of each pushbutton for providing a single second signal when any of the plurality of sensor means provides a first signal, a door on the elevator car, and door control means for controlling the operation of said door, wherein the door control means is connected to be responsive to the generation of said second single for modifying the operation of said door.

6. An elevator system, comprising:

a building having a plurality of floors, an elevator car mounted in said building, motive means for said elevator car for moving said elevator car to serve the floors in said building, car call means in said elevator car for registering calls for elevator service including a plurality of pushbuttons and associated visual indicating means, a first source of unidirectional potential having a first polarity, a second source of unidirectional potential having a second polarity, opposite said first polarity, each of said pushbuttons and its associated visual indicating means having first ends connected in common and second ends connected to said first and second sources, respectively, of unidirectional potential, sensor means for each pushbutton responsive to said first source appearing at the common connection for providing a first signal while its associated pushbutton is actuated, call memory means for each pushbutton switchable between first and second conditions, said call memory means switching from its first to its second condition in response to the associated sensor means providing said first signal, with said second condition indicating the registration of a call, driver means for each visual indicating means responsive to the associated call memory means being in its second condition for energizing the associated visual indicating means from said second source, and reset means switching a selected call memory means back to its first condition when a registered call associated therewith has been answered, each of said sensor means providing a first signal each time its associated pushbutton is actuated notwithstanding the associated call memory means being in its second condition when the pushbutton is actuated, means responsive to the sensor means of each pushbutton for providing a second signal when any sensor means provides a first signal, a door on the elevator car, door control means for controlling the operation of said door, said second signal being connected to said door control means for modifying the operation thereof.

7. An elevator system, comprising:

a building having a plurality of floors, an elevator car mounted in said building, motive means for said elevator car for moving said elevator car to serve the floors of said building, call means for registering a call for elevator service including at least one pushbutton and associated visual indicating means, a source of alternating potential, means rectifying said source of alternating potential to provide first and second sources of positive and negative half cycles, respectively, said pushbutton and visual indicating means each having first ends connected in common and second ends connected to said first and second sources, respectively, sensor means responsive to said first source appearing at the common connection for providing a first signal while said pushbutton is actuated, call memory means switchable between first and second conditions, said call memory means switching from its first to its second condition in response to said sensor means providing said first signal, with said second condition indicating the registration of a call, driver means responsive to said call memory means being in its second condition for energizing said visual indicating means from said second source, and reset means switching said call memory means back to its first condition when the registered call has been answered, said sensor means providing said first signal each time said pushbutton is actuated notwithstanding said call memory means being in its second condition when said pushbutton is actuated.

* * * * *